US008381933B2

(12) United States Patent
Wang et al.

(10) Patent No.: US 8,381,933 B2
(45) Date of Patent: Feb. 26, 2013

(54) GARBAGE BIN

(76) Inventors: Xin Wang, City of Industry, CA (US); Jiangqun Chen, JuJian (CN)

( * ) Notice: Subject to any disclaimer, the term of this patent is extended or adjusted under 35 U.S.C. 154(b) by 452 days.

(21) Appl. No.: 12/451,638

(22) PCT Filed: Nov. 12, 2007

(86) PCT No.: PCT/CN2007/003188

§ 371 (c)(1),
(2), (4) Date: Nov. 23, 2009

(87) PCT Pub. No.: WO2008/141497

PCT Pub. Date: Nov. 27, 2008

(65) Prior Publication Data

US 2010/0133286 A1 Jun. 3, 2010

(30) Foreign Application Priority Data

May 24, 2007 (CN) ..... 2007 1 0009008

(51) Int. Cl.
*B65D 90/60* (2006.01)
*B65D 3/26* (2006.01)
*B65D 43/26* (2006.01)

(52) U.S. Cl. ..... 220/211; 220/262; 220/264; 220/817; 220/819; 220/820; 220/821; 220/822; 220/823

(58) Field of Classification Search ..... 220/211, 220/260, 262, 264, 816, 817, 819–823
See application file for complete search history.

(56) References Cited

U.S. PATENT DOCUMENTS 5,170,904 A * 12/1992 Neuhaus ..... 220/262
5,329,212 A * 7/1994 Feigleson ..... 318/16
6,010,024 A * 1/2000 Wang ..... 220/23.87
6,596,983 B2 * 7/2003 Brent ..... 250/221
6,626,317 B2 * 9/2003 Pfiefer et al. ..... 220/263
6,774,586 B1 * 8/2004 Shih ..... 318/9
6,812,655 B1 * 11/2004 Wang et al. ..... 318/3
7,714,527 B2 * 5/2010 Wang et al. ..... 318/480
7,781,995 B2 * 8/2010 Yang et al. ..... 318/266
7,906,921 B2 * 3/2011 Wang et al. ..... 318/266
7,911,169 B2 * 3/2011 Wang et al. ..... 318/480

(Continued)

FOREIGN PATENT DOCUMENTS

CN 2296870 Y * 11/1998
CN 2529840 Y * 1/2003

(Continued)

*Primary Examiner* — J. Gregory Pickett
*Assistant Examiner* — Ned A Walker
(74) *Attorney, Agent, or Firm* — Raymond Y. Chan; David and Raymond Patent Firm

(57) ABSTRACT

A garbage bin includes a bin body, a bin head, an inducting window, a garbage inlet disposed on the bin head, a bin cover disposed on the garbage inlet, an upright shaft and a driving unit for making the upright shaft rotate. The upright shaft is connected to the driving unit, and the bin cover is connected to the upright shaft, in which the connecting point is not at the center of the bin cover. The advantages of the invention is that the rotating shaft of the bin cover is the upright shaft on the bin head, so when the bin cover rotates about the upright shaft, the bin cover opens horizontally about the upright shaft, so that the driving force is small, the energy consumption is low, and a user's hand is prevented from touching by the bin cover.

17 Claims, 5 Drawing Sheets

U.S. PATENT DOCUMENTS

| | | | | |
|---|---|---|---|---|
| 8,129,930 | B2 * | 3/2012 | Wang et al. | 318/283 |
| 2002/0030053 | A1 * | 3/2002 | Copeland | 220/253 |
| 2006/0196874 | A1 * | 9/2006 | Yang | 220/211 |
| 2006/0255033 | A1 * | 11/2006 | Yang et al. | 220/211 |
| 2007/0266637 | A1 * | 11/2007 | McGowan | 49/349 |
| 2009/0057317 | A1 * | 3/2009 | Wang et al. | 220/495.06 |
| 2010/0139071 | A1 * | 6/2010 | Wang et al. | 29/426.1 |
| 2011/0017735 | A1 * | 1/2011 | Wang et al. | 220/211 |

FOREIGN PATENT DOCUMENTS

| | | | | |
|---|---|---|---|---|
| CN | 2587803 | Y | * | 11/2003 |
| CN | 2835158 | Y | * | 11/2006 |
| DE | 29721614 | U1 | * | 2/1998 |
| DE | 202006003267 | U1 | * | 6/2006 |

* cited by examiner

GARBAGE BIN

BACKGROUND OF THE PRESENT INVENTION

1. Field of Invention

The present invention relates to a container, and more particularly to a container, such as a garbage bin, wherein the bin cover is actuated by induction and is horizontally moved to open up the bin body.

2. Description of Related Arts

The existing induction bin generally comprises a bin body and a bin head detachably supported on the bin body, such that the object, such as the trash, can be disposed out of the bin body when the bin head is detached from the bin body. The induction bin further comprises a bin cover movably coupled at the bin head and an induction unit operatively actuating the bin cover between an opened position and a closed position. When the induction unit detects an object within a sensing range, such as littering the trash, the bin cover is automatically actuated at its opened position. Otherwise, the bin cover is normally retained at its closed position. Since the user does not need to touch or contact the bin cover in order to operate of the bin cover, the automate bin cover brings lots of convenience and enhances the hygienic purpose of littering. However, such existing bin has a major drawback that the bin cover is pivotally and upwardly folded from the closed position to the opened position. In other words, when the induction unit detects the object with the sensing range, the bin cover is forced to upwardly fold so as to open up the bin body. Therefore, when the induction unit is activated, the operation requires a relatively larger the actuating power to not only pivotally lift up the bin cover but also overcome its own weight of the bin cover as well. Therefore, the operation requires a relatively larger actuating power and consumes lots of electrical power so as to shorten the service life span of the battery. The existing induction bin is always non-operated due to the insufficient electrical power of the battery. In addition, the user's hand will accidentally touch or contact the bin cover when the bin cover is pivotally folded to its opened position.

SUMMARY OF THE PRESENT INVENTION

An object of the present invention provides a horizontal open inducting garbage bin to overcome the above mentioned problems, wherein the horizontal open inducting garbage bin requires small drive force and low electrical energy, and the user's hand will not touched by the bin cover during operation.

Accordingly, the horizontal open inducting garbage bin comprises a bin body, a bin cover having an inlet and supporting on the bin body, and an inducting window. The garbage bin further comprises an actuation arrangement which comprises a driving shaft supported in an upright manner, and a driving unit for driving the driving shaft to rotate. Accordingly, the driving shaft is operatively coupled with the driving unit, wherein the driving shaft is eccentrically coupled with the bin cover. In other words, the connecting point of the driving shaft is not located at the center of the bin head.

Accordingly, the driving shaft is coupled with the bin cover and is operatively coupled with the driving unit, wherein the driving shaft is supported at the center portion of the bin head and is arranged in such a manner that when the driving unit is actuated, the bin cover is pivotally moved with respect to the driving shaft at a horizontal direction. Since the bin cover is pivotally moved at a horizontal direction, a relatively small actuating power is required to actuate the bin cover, so as to save the electrical power from the battery. In addition, since the bin cover is moved between the opened position and the closed position at a horizontal direction, the user' hand will not accidentally touch or contact the bin cover during operation.

Accordingly, the driving unit is preferably an electric motor powered unit or other powering unit.

The driving shaft is vertically supported in the bin head to affix to the bin cover. Alternatively, the driving shaft can be a tubular connection, or gear connection.

For affixing connection, the driving shaft is slidably and directly engaged with a tubular sleeve of the bin cover to affix the driving shaft to the bin cover.

For tubular connection, the driving shaft can be coupled with the bin cover through a connecting sleeve.

For gear connection, the driving shaft is coupled with the bin cover via a transmission gear, wherein the driving shaft is coupled at a gear shaft of the transmission gear to engage with a gear wheel provided at the bin cover.

According to the present invention, the bin cover can be a single cover member pivotally moving at a horizontal direction. Preferably, the bin cover comprises two cover members pivotally moving in a concurrent manner and pivotally moving at opposed horizontal direction.

The advantage of the single cover member is that the power transmission configuration is simplified since it requires driving one cover member between the opened position and the closed position. The advantage of the double cover members is that the opening space of the bin cover is relatively small to allow the cover members moving between the opened position and the closed position.

The horizontal open inducting garbage bin further comprises an actuation arrangement for transmitting the power from the driving unit to the bin cover so as to move the bin cover at a horizontal direction. The actuation arrangement comprises two cover gears, preferably two identical gears, having same gear ratio, wherein the cover gears are coupled with the two cover members respectively.

Accordingly, the two cover gears with the same gear ratio are arranged to drive the two cover members to concurrently move at a horizontal direction.

The actuation arrangement is received in an extension portion of the bin head, wherein the extension portion is downwardly extended from the rear portion of the bin head. When the bin head is supported on the bin body, the extension portion of the bin head is exteriorly located behind the bin body.

The bin body has a surface shaped and sized corresponding to a corresponding surface of the extension portion of the bin head to be contacted with each other.

The bin body has a receiving cavity defined behind the rear wall of the bin body to receive the extension portion of the bin head.

The rear wall of the bin body is shaped and sized corresponding to the front wall of the extension portion of the bin head.

The inducting window is located at the top side of the bin head at the rear portion thereof.

The inducting window is located at the rear portion of the bin head to minimize the false actuation of the bin cover.

The inducting window is supported at an inclined orientation at a predetermined angle with respect to the top surface of the bin head.

Having the inclination of the induction window, the detaching range of the induction means can be substantially enlarged to efficiently activate the induction means.

Accordingly, the present invention provides the following advantages.

Since the bin cover is pivotally coupled with the bin head via the upright driving shaft, the bin cover will be driven to pivotally move with respect to the driving shaft at a horizontally direction. In other words, the driving shaft forms a pivot axle of the bin cover to move horizontally, such that the actuating power to move the bin cover is relatively small so as to minimize the electrical energy consumption. In addition, when the bin cover is horizontally moved, the user's hand will not touch or contact with the bin cover accidentally. Since the induction window is located at the rear portion of the bin head, the induction means will not be accidentally activated when the user passes by the front side of the bin head so as to minimize the false operation of the garbage bin of the present invention.

These and other objectives, features, and advantages of the present invention will become apparent from the following detailed description, the accompanying drawings, and the appended claims.

DETAILED DESCRIPTION OF THE PREFERRED EMBODIMENT

Figure 1:
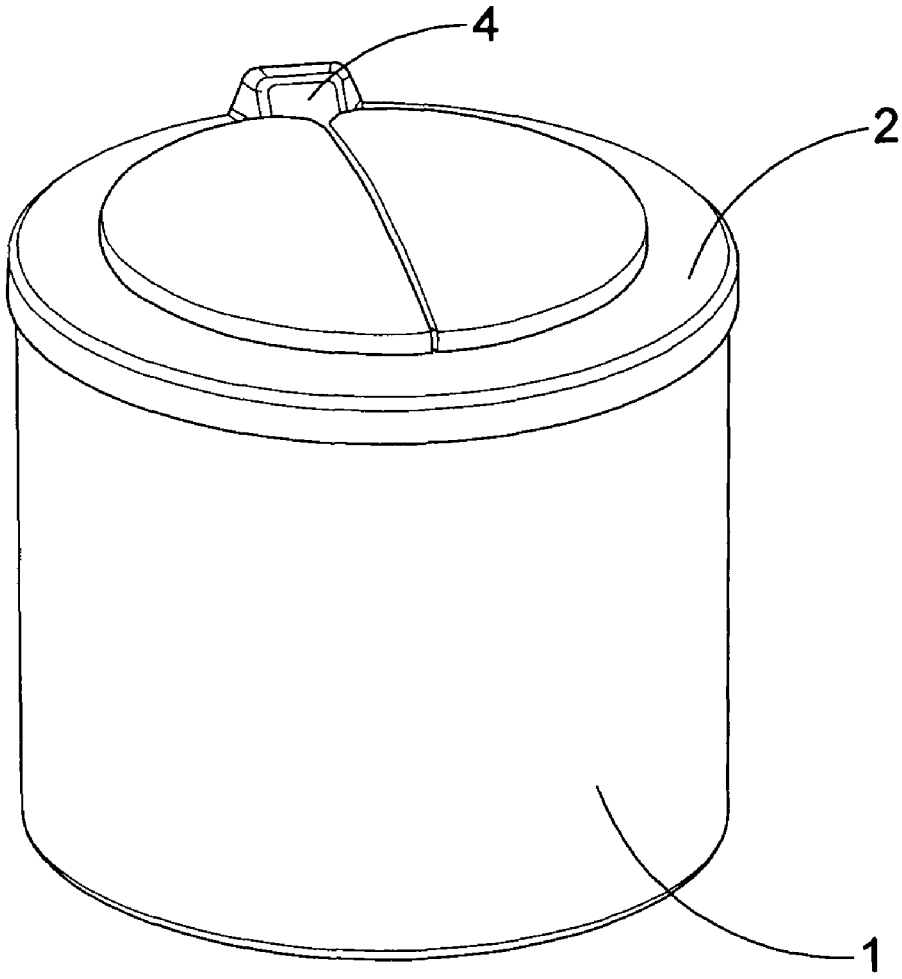
FIG. 1 is a perspective view of a horizontal open inducting garbage bin according to a preferred embodiment of the present invention, illustrating the bin cover at the closed position.
Figure 2:
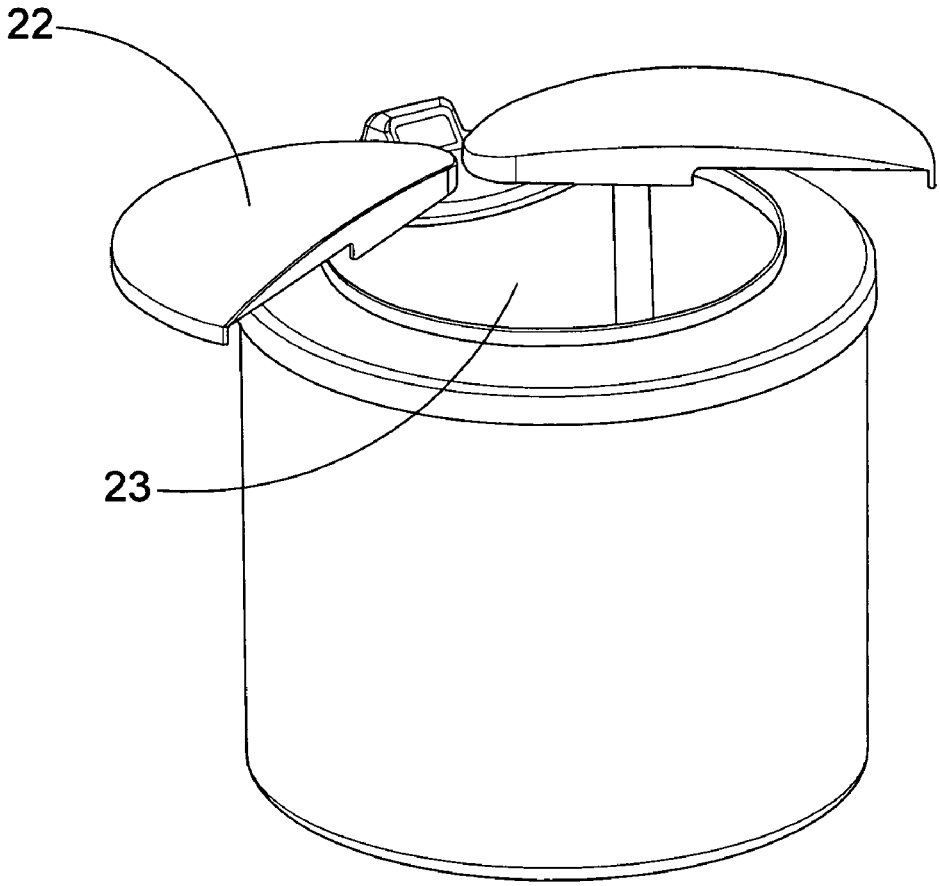
FIG. 2 is a perspective view of the horizontal open inducting garbage bin according to the above preferred embodiment of the present invention, illustrating the bin cover at the opened position.
Figure 3:
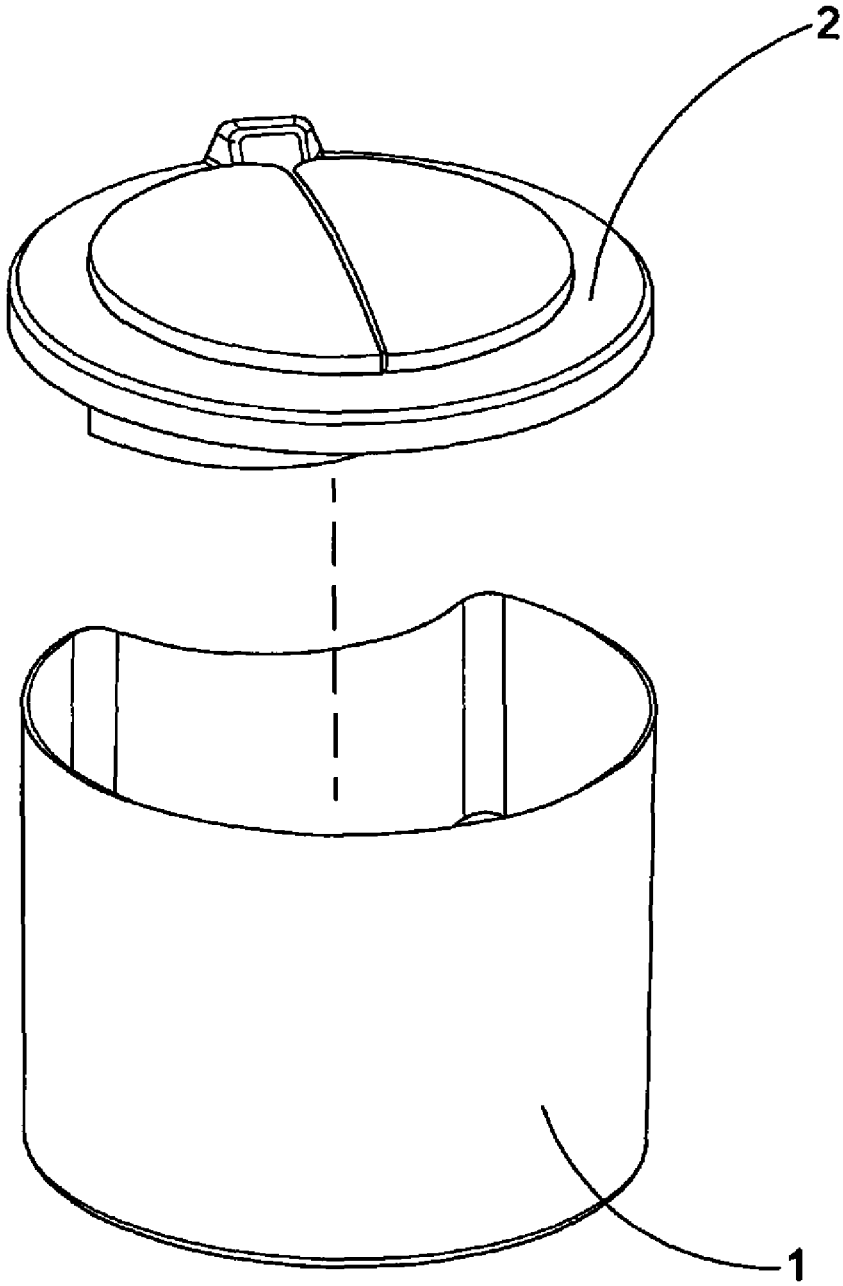
FIG. 3 is a perspective view of the horizontal open inducting garbage bin according to the above preferred embodiment of the present invention, illustrating the bin head being detached from the bin body.
Figure 4:
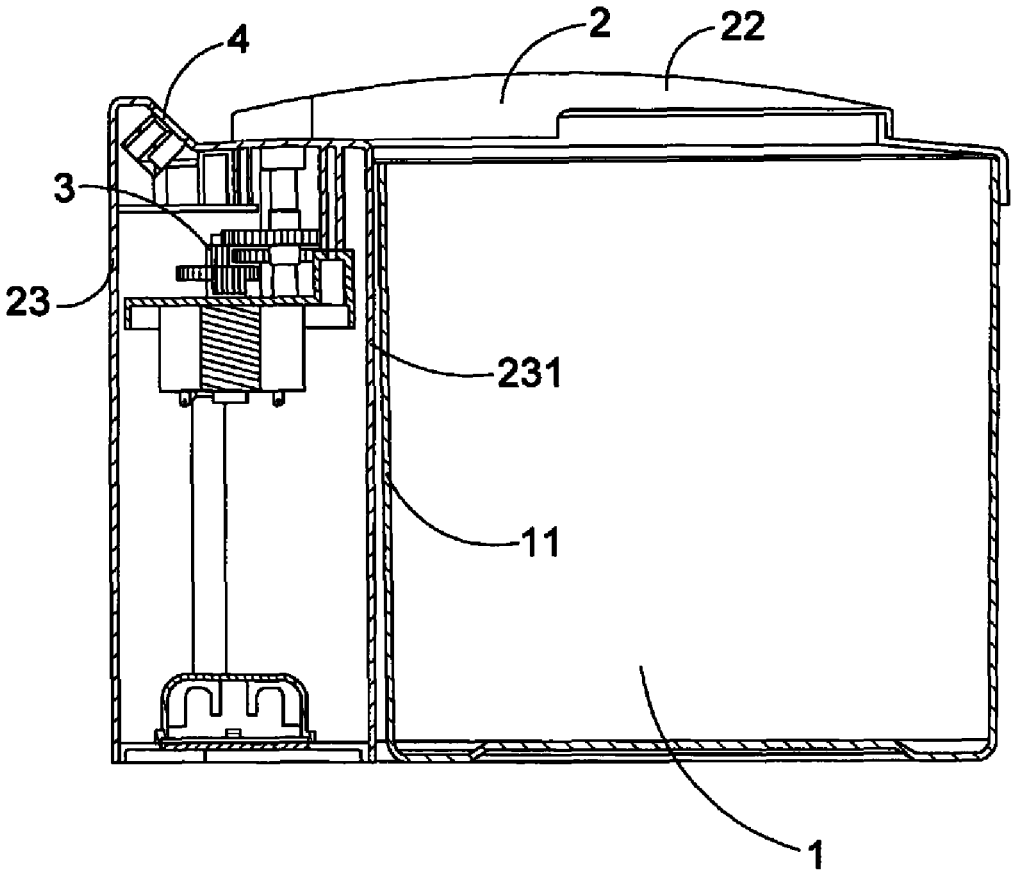
FIG. 4 is a sectional view of the horizontal open inducting garbage bin according to the above preferred embodiment of the present invention.
Figure 5:
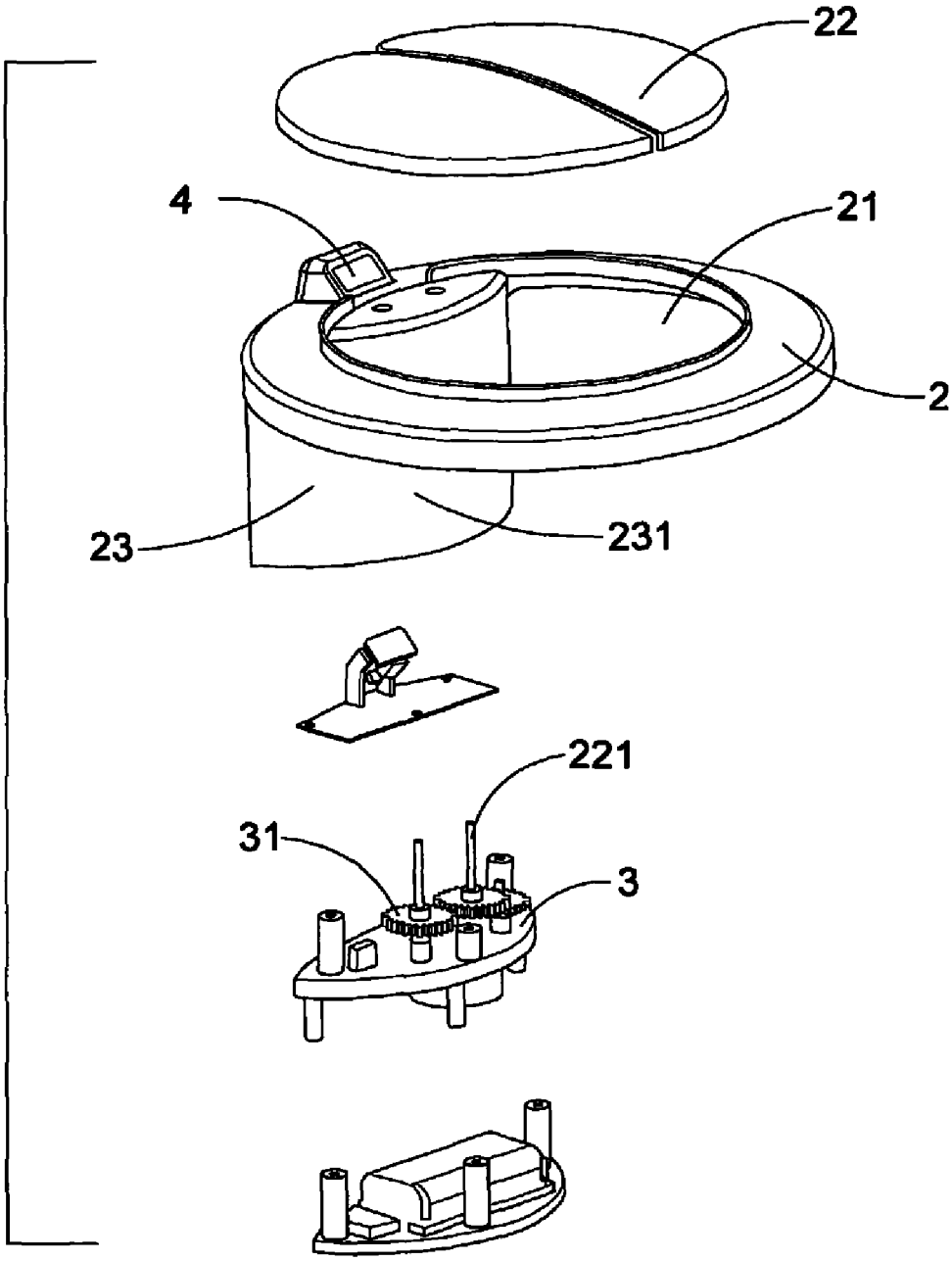
FIG. 5 is an exploded perspective view of the bin head of the horizontal open inducting garbage bin according to the above preferred embodiment of the present invention.

As shown in FIGS. 1 to 5 of the drawings, a horizontal open inducting garbage bin according to a preferred embodiment of the present invention is illustrated, wherein the horizontal open inducting garbage bin comprises a bin body 1, a bin head 2, an actuation arrangement 3 being activated by means of induction means, an induction window 4 communicating with the induction means for detecting an approaching target, and a driving unit which comprises an electric motor. The bin head 2 is detachably supported on the bin body 1. The bin head 2 has an inlet 21 and a bin cover 22 movably coupled at the bin head 2 to move between a closed position that the bin cover 22 is moved to cover the inlet 21 to enclose the bin body 1 and an opened position that the bin cover is moved to uncover the inlet 21 for exposing the interior of the bin body 1. Accordingly, the bin cover 22 comprises two cover members pivotally coupled at the bin head 2. The bin head 2 further comprises at least a driving shaft 221 supported in an upright manner. Accordingly, the driving shaft 221 is coupled with each of the cover members of the bin cover 22 such that the driving shaft 221 forms as a driving axle of the respective cover member. The actuation arrangement 3 comprises a gear unit for transmitting the power from the driving unit to the bin cover 22, wherein the gear unit comprises two cover gears, having same gear ratio, engaging with each other and coupling with the cover members of the bin cover 22 respectively to concurrently actuate the cover members. Accordingly, the driving shaft 221 is vertically coupled at the center of the respective cover gear such that when the cover gear is rotated, the respective cover member is driven to move with respect to the driving shaft 221 in a horizontal direction. In other words, when the cover gears are rotated, the cover members of the bin cover 22 are driven to pivotally and outwardly move to the opened position in a horizontal direction, and when the cover gears are reversely rotated, the cover members of the bin cover 22 are driven to pivotally and inwardly move to the closed position in a horizontal direction. In addition, the gear unit further comprises a power gear 31 operatively coupling with the output shaft of the driving unit and operatively engaging with one of the cover gears such that when the power gear 31 is driven to rotate by the driving unit, the two cover gears are driven to rotate concurrently. According to the preferred embodiment, the actuating arrangement 3 is supported within an extension portion 23 of the bin head 2, wherein the extension portion 23 is downwardly extended from the rear portion of the bin head 2. Correspondingly, the bin body 1 has an indented rear wall 11 having a curved configuration corresponding to a curved front wall 231 of the extension portion 23 of the bin head 2. Therefore, when the bin head 2 is detachably supported on the bin body 1, the extension portion 23 of the bin head 2 is located behind the rear wall 11 of the bin body 1 that the front wall 231 of the bin head 2 is overlapped with the rear wall 11 of the bin body 1. The inducting window 4 is located on top of the bin head 2 at the rear portion thereof, wherein the inducting window 4 is supported at an inclined orientation with respect to the top surface of the bin head 2 for enlarging the detaching range of the induction means.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A garbage bin, comprising:

a bin body;

a bin head being detachably supported on said bin body, said bin head having an inlet, a top side, a rear portion with an inducting window, and an extension portion extending downwardly from said rear portion;

an induction means for detecting an approaching target, wherein said inducting window communicates with said induction means, wherein said inducting window is supported at an inclined orientation at a predetermined angle with respect to a top surface of said bin head;

a bin cover movably coupled at said bin head to move between an opened position and a closed position;

a driving shaft supported in said bin head in an upright manner and eccentrically coupled with said bin cover;

a driving unit arranged to drive said driving shaft to rotate so as to horizontally move said bin cover between said opened position and said closed position;

a connection structure coupling between said driving shaft and said bin cover to enable said driving shaft to move said bin cover through said connection structure; and an actuation arrangement for transmitting power from said driving unit to said bin cover, wherein said actuation arrangement is housed in said extension portion of said bin head, wherein said extension portion is located at an exterior of said bin body when said bin head is supported on said bin body.

2. The garbage bin, as recited in claim 1, wherein said bin body has a receiving cavity for receiving said extension portion of said bin head.

3. The garbage bin, as recited in claim 1, wherein said connection structure comprises a tubular sleeve connected between said driving shaft and said bin cover, so that said driving shaft is engaged with said bin cover through said tubular sleeve for driving said bin cover to move between said opened position and said closed position.

4. The garbage bin, as recited in claim 3, wherein said bin cover comprises a plurality of cover members arranged to pivotally move in a horizontal direction for closing said bin cover.

5. The garbage bin, as recited in claim 1, wherein said connection structure comprises a transmission gear connected between said driving shaft and said bin cover, wherein said driving shaft is engaged with said bin cover through said transmission gear for driving said bin cover to move between said opened position and said closed position.

6. The garbage bin, as recited in claim 5, wherein said bin cover comprises a plurality of cover members arranged to pivotally move in an opposed horizontal direction for opening said bin cover.

7. A garbage bin, comprising:

a bin body;

a bin head detachably supported on said bin body, said bin head having an inlet, a top side, a rear portion with an inducting window, and an extension portion extending downwardly from said rear portion;

an induction means for detecting an approaching target, wherein said inducting window communicates with said induction means, wherein said inducting window is supported at an inclined orientation at a predetermined angle with respect to a top surface of said bin head;

a bin cover movably coupled at said bin head to move between an opened position and a closed position;

a driving shaft supported in said bin head in an upright manner and eccentrically coupled with said bin cover;

a driving unit arranged to drive said driving shaft to rotate so as to horizontally move said bin cover between said opened position and said closed position; and a connection structure coupling between said driving shaft and said bin cover to enable said driving shaft to move said bin cover through said connection structure, wherein said connection structure comprises a tubular sleeve connected between said driving shaft and said bin cover, so that said driving shaft is engaged with said bin cover through said tubular sleeve for driving said bin cover to move between said opened position and said closed position, wherein said connection structure comprises a transmission gear connected between said driving shaft and said bin cover, wherein said driving shaft is engaged with said bin cover through said transmission gear for driving said bin cover to move between said opened position and said closed position.

8. The garbage bin, as recited in claim 7, wherein said bin cover comprises a plurality of cover members arranged to pivotally move in a horizontal direction for closing said bin body.

9. The garbage bin, as recited in claim 7, further comprising an actuation arrangement for transmitting power from said driving unit to said bin cover, wherein said actuation arrangement is housed in said extension portion of said bin head, wherein said extension portion is located at an exterior of said bin body when said bin head is supported on said bin body.

10. The garbage bin, as recited in claim 8, further comprising an actuation arrangement for transmitting power from said driving unit to said bin cover, wherein said actuation arrangement is housed in said extension portion of said bin head, wherein said extension portion is located at an exterior of said bin body when said bin head is supported on said bin body.

11. The garbage bin, as recited in claim 9, wherein said bin body has a receiving cavity for receiving said extension portion of said bin head.

12. The garbage bin, as recited in claim 10, wherein said bin body has a receiving cavity for receiving said extension portion of said bin head.

13. A garbage bin, comprising:

a bin body;

a bin head detachably supported on said bin body, said bin head having an inlet, a top side, a rear portion with an inducting window, and an extension portion extending downwardly from said rear portion;

an induction means for detecting an approaching target, wherein said inducting window communicates with said induction means, wherein said inducting window is supported at an inclined orientation at a predetermined angle with respect to a top surface of said bin head;

a bin cover movably coupled at said bin head, said bin cover having a plurality of cover members that horizontally pivot between an opened position and a closed position, wherein said bin body has a receiving cavity for receiving said extension portion of said bin head;

a driving shaft supported in said bin head in an upright manner and eccentrically coupled with said bin cover;

a driving unit arranged to drive said driving shaft to rotate so as to horizontally pivot said cover members between said opened position and said closed position; and a connection structure coupling between said driving shaft and said bin cover to enable said driving shaft to move said bin cover through said connection structure.

14. The garbage bin, as recited in claim 13, wherein said connection structure comprises a tubular sleeve connected between said driving shaft and said bin cover, so that said driving shaft is engaged with said bin cover through said tubular sleeve for driving said bin cover to move between said opened position and said closed position.

15. The garbage bin, as recited in claim 13, wherein said connection structure comprises a transmission gear connected between said driving shaft and said bin cover, wherein said driving shaft is engaged with said bin cover through said transmission gear for driving said bin cover to move between said opened position and said closed position.

16. The garbage bin, as recited in claim 13, further comprising an actuation arrangement for transmitting power from said driving unit to said bin cover, wherein said actuation arrangement is housed in said extension portion of said bin head, wherein said extension portion is located at an exterior of said bin body when said bin head is supported on said bin body.

17. The garbage bin, as recited in claim 16, further comprising an actuation arrangement for transmitting power from said driving unit to said bin cover, wherein said actuation arrangement is housed in said extension portion of said bin head, wherein said extension portion is located at an exterior of said bin body when said bin head is supported on said bin body.

* * * * *